US007444825B2

(12) United States Patent
Miller, Jr. et al.

(10) Patent No.: US 7,444,825 B2
(45) Date of Patent: Nov. 4, 2008

(54) REFRIGERATED PRODUCT MERCHANDISING UNIT

(75) Inventors: Donald J. Miller, Jr., Belleville, IL (US); Kent Lee Hanners, St. Charles, MO (US); Johnny P. Glasgow, Overland, MO (US)

(73) Assignee: Presence From Innovation, LLC, St. Louis, MO (US)

( * ) Notice: Subject to any disclaimer, the term of this patent is extended or adjusted under 35 U.S.C. 154(b) by 262 days.

(21) Appl. No.: 11/162,699

(22) Filed: Sep. 20, 2005

(65) Prior Publication Data

US 2007/0062210 A1 Mar. 22, 2007

(51) Int. Cl.
*A47F 3/04* (2006.01)

(52) U.S. Cl. ..... 62/255; 62/419

(58) Field of Classification Search ..... 62/246, 62/255, 419

See application file for complete search history.

(56) References Cited

U.S. PATENT DOCUMENTS

| | | | | | |
|---|---|---|---|---|---|
| 1,002,333 | A | | 9/1911 | Stollberg | |
| 2,546,417 | A | * | 3/1951 | Anglin | 62/281 |
| 2,880,596 | A | * | 4/1959 | Brown et al. | 62/246 |
| 2,967,404 | A | | 1/1961 | Detwiler | |
| 3,491,548 | A | * | 1/1970 | Christiansen | 62/255 |
| 3,561,230 | A | | 2/1971 | Gatton et al. | |
| 4,019,339 | A | | 4/1977 | Anderson | |
| 4,106,305 | A | | 8/1978 | Ibrahim | |
| 4,724,682 | A | | 2/1988 | Flum et al. | |
| 4,845,957 | A | * | 7/1989 | Richardson | 62/255 |
| 4,941,327 | A | | 7/1990 | Miles | |
| 4,982,840 | A | | 1/1991 | Bidwell et al. | |
| 5,048,171 | A | | 9/1991 | Bidwell et al. | |
| 5,347,827 | A | * | 9/1994 | Rudick et al. | 62/440 |
| 5,458,407 | A | * | 10/1995 | Bustos et al. | 312/116 |
| 5,590,541 | A | * | 1/1997 | Rainwater | 62/255 |
| 5,689,967 | A | * | 11/1997 | Floysvik | 62/255 |
| 5,718,124 | A | * | 2/1998 | Senecal | 62/457.6 |
| 5,910,162 | A | | 6/1999 | Harbour et al. | |
| 6,363,740 | B1 | | 4/2002 | Hansen | |
| 6,612,123 | B2 | | 9/2003 | Miller, Jr. et al. | |
| 6,637,233 | B1 | | 10/2003 | Flum | |
| 6,763,667 | B1 | * | 7/2004 | Jennings et al. | 62/56 |
| 6,799,433 | B1 | | 10/2004 | Gleason et al. | |
| 6,976,371 | B2 | | 12/2005 | Gleason et al. | |
| 6,990,828 | B2 | * | 1/2006 | Kim et al. | 62/381 |
| 2005/0210884 | A1 | | 9/2005 | Tuskiewicz | |

* cited by examiner

*Primary Examiner*—William E Tapolcai
(74) *Attorney, Agent, or Firm*—Husch Blackwell Sanders LLP

(57) ABSTRACT

A refrigerated product merchandising unit for storing and displaying chilled products including a body member, a product holding container positionable within the body member, and a base member having a refrigeration unit associated therewith, the refrigeration unit being positionable within the body member and being adapted for providing cold air to the product holding container. The product holding container includes a first plurality of openings positioned adjacent the top end portion thereof for allowing cold air to enter the product holding container and a second plurality of openings positioned adjacent the bottom end portion thereof for allowing air to exit the product holding container for recycling through the refrigeration unit. A member is provided for segregating air exiting the product holding container from the cold air being delivered to the product holding container such that air exiting the product holding container cannot be redirected to the first plurality of openings without first passing through the refrigeration unit.

48 Claims, 6 Drawing Sheets

REFRIGERATED PRODUCT MERCHANDISING UNIT

BACKGROUND OF INVENTION

The present invention relates generally to product merchandising display devices for use in storing and displaying for sale products or articles such as bottled or canned soft drink beverages, fruit juices and the like and, more particularly, to several embodiments of a totally integrated refrigerated product merchandising unit which utilizes a forced-air delivery system for merchandising chilled products to consumers. No ice or cold water is necessary for chilling the products positioned within the present product merchandising units. Instead, a unique air chamber design provides continuous cold air flow to the internal product holding cavity or receptacle which holds the various products for sale to consumers for cooling and chilling the products positioned therewithin.

Point of sale merchandising units are commonly used for merchandising single unit articles such as bottled or canned soft drink and fruit juice type beverages. Since these items are typically impulse type items, such point of sale units are typically located throughout a store environment at strategic locations such as at food counters, checkout counters, end aisle locations, and other high customer traffic locations throughout the store environment. When merchandising chilled products, such point of sale merchandising units are typically adapted for holding ice so as to chill the beverage containers or other chilled products positioned therewithin. Because ice is typically used in these types of container assemblies, these units also include appropriate drainage mechanisms for periodically draining waste water from the melted ice which will accumulate within the container assembly. Such drainage mechanisms may include a drain tank assembly, a reservoir assembly, appropriate tubing and/or spigot means for periodically emptying the drain tank or reservoir assembly, and other drain assemblies. In many cases, additional floor support members and platform members are necessary in order to adequately hold and support a large capacity drain tank assembly. In other embodiments where a drain tank assembly is not utilized, melted waste water is allowed to accumulate in the bottom of the product holding cavity or receptacle and is thereafter removed by opening a spigot or unclamping a drain tube which is connected to the bottom portion of the product holding container so as to allow the waste water to drain therethrough to the outside of the overall assembly. A bucket or other receiving means is typically positioned underneath the drain tube or spigot to receive the liquid from the melted ice. Unfortunately, these drainage mechanisms typically leak thereby causing wet areas around the product merchandising unit and other potential hazards.

Another disadvantage to using a product merchandising container which is filled with ice and articles for sale is that, as the ice melts, the articles will gradually become immersed in cold water. This necessitates reaching into the cold water to retrieve the articles which can be uncomfortable and can cause consumers to select an article for sale from a different, more inviting display. Such an arrangement can also be unattractive depending upon the amount of melted ice within the container. In this regard, germs on customer hands can be released into the water when consumers reach therein to obtain an article.

Accordingly, the present invention is directed to overcoming one or more of the problems as set forth above and discloses several embodiments of a product merchandising unit which includes a forced-air refrigeration system completely enclosed therewithin and below the product holding cavity for more efficiently providing cold air in and around the product containers positioned within the unit for quickly chilling the product containers positioned therewithin and keeping such product containers continuously cold throughout the selling period.

SUMMARY OF INVENTION

The present invention overcomes many of the shortcomings and limitations of the prior art devices discussed above and teaches the construction and operation of several embodiments of a refrigerated product merchandising unit which utilizes a refrigeration unit for delivering cold forced-air to products positioned within the product holding cavity for cooling and chilling such products for consumer use. The present units provide an attractive, inviting display in which articles for sale are chilled and made readily and conveniently accessible to the consumer at the top of the unit. No ice or accumulated waste water from the melted ice is associated with the present units and therefore no drainage mechanism for periodically removing and draining such waste water associated with prior art cooler assemblies is necessary.

More particularly, the present product merchandising units include a base unit, an outer body member or shell member, and an inner tub member, or other product holding receptacle or container having an internal cavity associated therewith adapted for receiving and holding beverage products or other articles for sale. Although the outer body member or shell member of the present assembly is preferably cylindrical in shape, other container shapes and configurations such as rectangular, square, triangular and trapezoidal configurations will likewise work well as will be hereinafter explained. The tub member or product holding container is typically cooperatively engageable with the upper edge portion of the outer body member, although other means for holding the tub member within the body member may likewise be utilized. The tub member may also be integrally formed with the outer body member and includes an opened upper end portion, a lower or bottom end portion forming the bottom surface of the tub member, and a sidewall extending between the upper and lower end portions thereof defining an internal cavity therebetween. The tub member is sized and shaped to fit within the outer body member and to be supported therewithin.

The base unit includes a totally integrated refrigeration system mounted to a wheel base assembly for easy mobility from one location to another. The refrigeration unit is self-contained and can be of any conventional structure so as to be received within the outer body member as will be hereinafter explained. The refrigeration system typically includes a compressor, one or more fans, evaporator coils, a condensation pan, a supply air side, a return air side, power means and other appropriate components. The base unit is sized and configured such that the outer body member or shell member can be positioned over the base unit such that the refrigeration system is completely enclosed and contained therewithin. A plurality of screws or other fastening means removably attaches the outer body member to the base unit.

The tub member includes a first plurality of inlet openings or slots strategically positioned around the top portion of such member for allowing incoming cold air delivered from the supply side of the refrigeration system to circulate around the outer periphery of the tub member and enter the interior cavity of such tub member so as to further circulate around the product containers positioned therewithin and chill the same. The size and shape of these openings or slots can be varied depending upon the size and shape of the tub member and/or product holding container as well as depending upon the type of products being positioned therewithin. As the cold air circulates around the outer periphery of the tub member and through the inlet openings associated with the top portion thereof, such cold air will circulate from top to bottom through the interior portion of the tub member. A second set of exit or outlet openings or slots are located along only a portion of the bottom portion of the tub member for allowing the cool air to exit the tub member and return to the refrigeration unit for recooling and recirculation back through the tub member. This second set of exit or outlet openings functions as the return air outlet allowing such air to exit the tub member and flow to the return side of the refrigeration unit located therebelow whereby such air is recooled and then resupplied to the tub member through the supply side of the refrigeration system.

A flange member or other divider structure is provided around the return air exit openings in the tub member so as to segregate the supply side area of the overall unit from the return side area so that the return air cannot cycle back to the top of the tub member without first passing through the refrigeration unit. This ensures that cold air will constantly be supplied to the products positioned within the tub member thereby effectively keeping the products positioned therewithin cold at all times.

The tub member, outer body member, refrigeration unit, and in some embodiments the flange member, form a space or duct therebetween for more effectively channeling cold air to the products positioned within the tub member or product holding container. No additional duct work or other means are necessary for effectively cooling the products positioned within the tub member. This unique air chamber design provides continuous cold forced-air flow for circulation around and through the interior cavity of the tub member, which forced-air cooling is more efficient and clean as compared to ice and/or freeze-plate technology, and which design provides faster cooling and keeps the products colder for a longer period of time.

The present tub member may likewise be suitably provided with means to accommodate a see-through lid member which is designed to rest upon and/or be attached to the upper portion of the tub member. The lid member serves to close the tub member, provides visibility to the contents positioned therewithin, and provides ready access to the articles therein by consumers. Lid members of various shapes and styles may be used in conjunction with the present tub member.

In addition, in some embodiments, the lid member and/or the outer body member or shell member may include means for holding and displaying visual information such as promotional advertisements for promoting the products displayed within the merchandising unit. Graphics and other advertising information may likewise be applied directly to the outer body member. Wheel means are also optionally provided on the bottom portion of the base unit to facilitate moving the present units from one merchandising location to another.

In the event that the refrigeration system must be serviced or otherwise fails, the outer body member can be easily and quickly unfastened from the base unit and the entire base unit including the wheel base and refrigeration system mounted thereon can be packaged and shipped for appropriate repairs. In this event, a new base unit along with a new refrigeration system can be easily substituted for the serviced system and this replacement can be handled by field personnel while the unit is still in the store environment. Replacement of the refrigeration unit can be made with a simple screwdriver and no technical expertise is involved.

These and other aspects and advantages of the present invention will become apparent to those skilled in the art after considering the following detailed description in connection with the accompanying drawings.

BRIEF DESCRIPTION OF DRAWINGS

For a better understanding of the present invention, reference may be made to the accompanying drawings.

DETAILED DESCRIPTION

For illustrative purposes only, the present product merchandising units for displaying and merchandising chilled articles including the present base unit, outer body member, and product holding container or tub member are described and disclosed herein as substantially cylindrically shaped members. It is anticipated and recognized that the present product merchandising units constructed according to the teachings of the present invention can likewise be fashioned into a wide variety of different sizes and shapes and that the internal components of the present units such as the base unit, outer body member and tub member may likewise be correspondingly shaped to conform to the shape of the overall unit without departing from the teachings and practice of the present invention.

Figure 1:
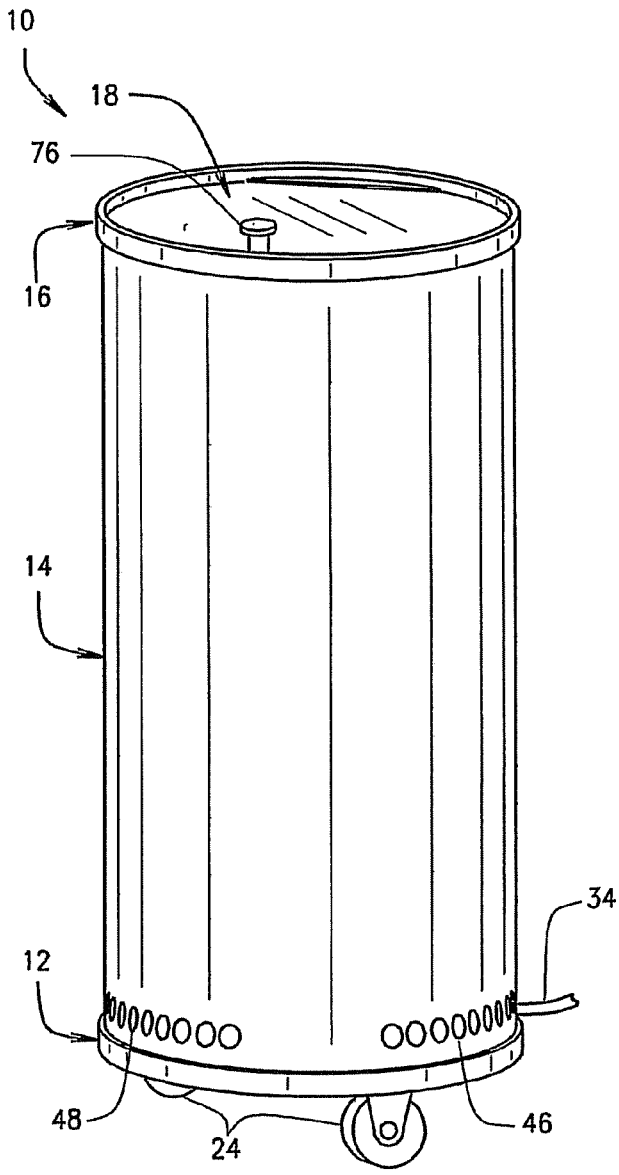
FIG. 1 is a perspective view of one embodiment a product merchandising unit constructed according to the teachings of the present invention.
Figure 2:
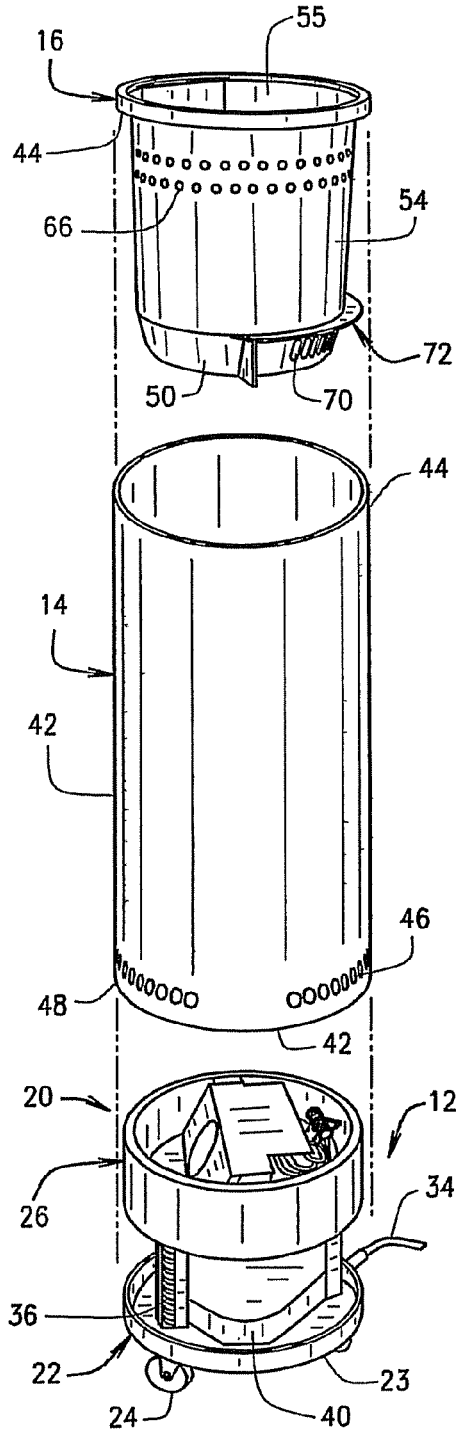
FIG. 2 is an exploded view showing the main components associated with the product merchandising unit of FIG. 1.

Referring to the drawings more particularly by reference numerals wherein like numerals refer to like parts, number 10 in FIGS. 1 and 2 identifies one embodiment of a product merchandising unit constructed according to the teachings of the present invention. The product merchandising unit 10 includes a base unit or assembly 12, a generally hollow outer body member 14, a correspondingly shaped tub member or product holding container 16, and a lid member 18. When all of the above components are assembled to form the merchandising unit 10 as illustrated in FIG. 1, the result is a container assembly that can store and maintain chilled products without using ice, and without worrying about waste water leakage problems.

Figure 3:
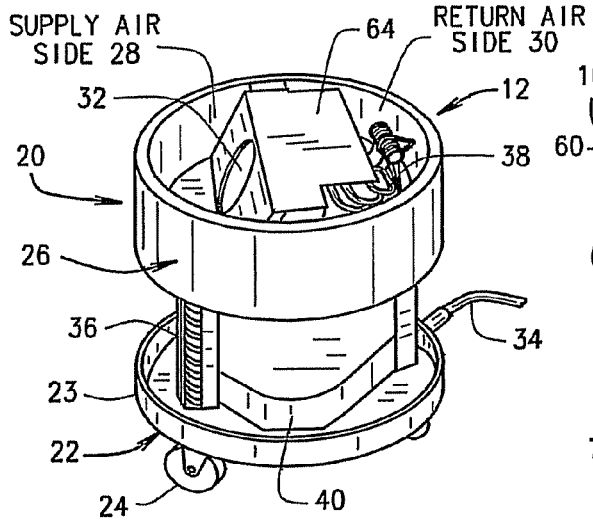
FIG. 3 is perspective view of the base unit associated with the product merchandising unit of FIG. 1.
Figure 4:
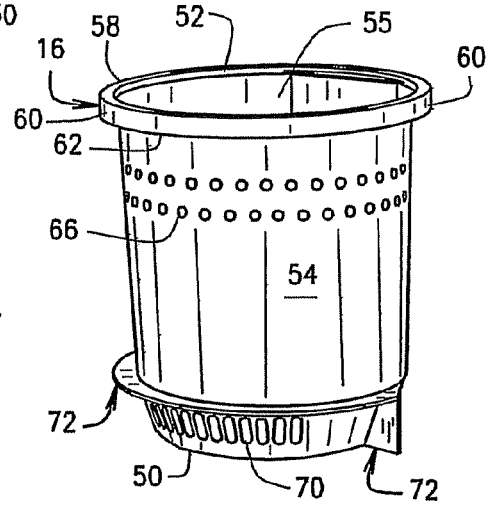
FIG. 4 is a perspective view of the tub member or product holding container associated with the product merchandising unit of FIG. 1.

As best illustrated in FIGS. 2-4, the base unit 12 includes a refrigeration unit 20 fixedly mounted to a wheel base assembly 22 for easy mobility from one location to another. In this regard, wheel base assembly 22 preferably includes a plurality of casters or other wheel or rolling means 24 for facilitating movement of the overall unit 10 from one location to another. Wheel means 24 can be strategically positioned and located on the bottom surface of assembly 22 to provide stability to the overall unit 10 both when in motion and under static conditions. It is also recognized that the base assembly 22 may also be fabricated without any type of wheel or rolling means associated therewith.

Refrigeration unit 20 is a totally integrated system for providing cold forced-air to the products positioned within the tub member 16 as will be hereinafter explained. The refrigeration system 20 can be of any conventional construction and will typically be a simple closed-circuit system having one or more compressors, fans, evaporators, condensers, condensation pan, appropriate valving and tubing, and other conventional components for cooling air to a specific temperature or to a specific range of temperatures. As best shown in FIGS. 2 and 3, the refrigeration unit 20 is mounted to the base assembly 22 in a conventional manner such as through the use of conventional fastening means and includes an upper housing member 26 which is divided into a supply air side portion 28 and a return air side portion 30. Air is circulated through the refrigeration unit 20 and cold forced-air is delivered from the supply air side portion 28 via fan means 32 to the tub member or product holding container 16 as will be hereinafter further explained. After the cold air has been circulated through the tub member 16 and the chilled products positioned therewithin, it will be returned to the refrigeration unit 20 via the return air side portion 30 as will be likewise hereinafter further explained. This returned air will then be recirculated through refrigeration unit 20 for recooling and will again be delivered as cold forced-air to the tub member 16 as previously explained. Refrigeration unit 20 will include power means such as power cord 34 for providing electrical power to the compressor unit and other electrical components of the refrigeration unit for cooling air in a conventional manner.

The refrigeration unit 20 will typically include a compressor assembly (not shown), a condenser 36, evaporator coils 38, appropriate tubing and valving, and a condensation pan such as condensation pan 40 illustrated in FIG. 3 for receiving any condensation or other moisture from the condenser 36, evaporator coils 38, and other system components. The compressor assembly and condenser 36 are positioned below the upper housing member 26 and the condenser 36 keeps the refrigerant circulating continuously in a closed circuit within the evaporator coils 38 at all times. A second fan (not shown) may be positioned adjacent to or in the vicinity of the condenser 36 for pulling air through the condenser for cooling the refrigerant which passes therethrough. Return air recycled from tub member 16 is cycled over the evaporator coils 38 for recooling and is thereafter recirculated to the tub member 16 via the circulation fan 32.

The outer body member or shell member 14 is illustrated as being a generally hollow cylindrically shaped outer member of conventional construction having a lower end portion 42 and an upper edge portion 44. Body member 14 can be fabricated as a single unitary unit, or such member can be formed from a plurality of cooperatively engageable panels, or from a single flat sheet of flexible or resilient material which includes complimentary interlocking edge portions for cooperatively attaching the opposed end portions of the sheet member to form the body member 14. Other constructions and methods for forming body member 14 are likewise recognized and anticipated. Here again, although body member 14 is illustrated as being substantially cylindrical or barrel shaped, it is recognized and anticipated that body member 14 may take on a wide variety of different shapes and configurations.

Lower end portion 42 of body member 14 is shaped and configured so as to cooperatively receive refrigeration unit 20 as best illustrated in FIG. 2. In this regard, lower end portion 42 can be removably attached to base unit 12 via any suitable conventional means such as by overlapping the lower end portion of outer body member 14 with the peripheral flange portion 23 associated with wheel base assembly 22 and attaching such members to each other via conventional fastening means. Other means for attaching body member 14 to base unit 12 are likewise envisioned and may be utilized without departing from the spirit and scope of the present invention. Lower end portion 42 of body member 14 also includes a plurality of openings 46 and 48. These openings serve as cooling means for cooling the condenser 36 as well as other components of the refrigeration unit 20 by allowing ambient air to enter and exit the lower portion of unit 10. For example, one set of openings 46 and 48 may be utilized to draw ambient air into body member 14 and refrigeration unit 20 and across condenser 36 for cooling the refrigerant circulating within evaporator coils 38 via an additional fan associated with condenser 36 and the other set of openings 46 and 48 can be utilized to allow the warm air exiting condenser 36 to exit refrigeration unit 20 and body member 14. Other arrangements and means for cooling refrigeration unit 20 are likewise anticipated and recognized. Once positioned over refrigeration unit 20 and base unit 12, outer body member 14 substantially encloses refrigeration unit 20.

Figure 5:
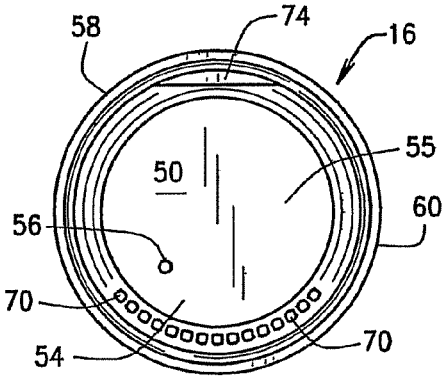
FIG. 5 is a top plan view of the tub member or product holding container of FIG. 4.

Referring to FIGS. 4 and 5, the tub member or product holding container 16 is preferably a one-piece member and includes a lower bottom wall portion 50, an opposite open upper end portion 52, and a continuous side wall portion 54 extending therebetween defining an internal cavity 55 for holding products therewithin. The lower bottom wall portion 50 may include a drain opening 56 with appropriate tubing for removing any condensation which may accumulate within the product holding cavity 55 and/or for removing any leakage from product containers housed therewithin. This condensation or product leakage may be funneled from tub member 16 via a drain hose (not shown) to the return air side portion 30 of refrigeration unit 20 and then to condensation pan 40 for evaporation. Other collection means may likewise be utilized. In this regard, the lower bottom tub wall portion 50 may be tapered or funnel shaped towards the drain hole 56 so as to enable any condensation or product leakage to flow unrestrictedly to the drain opening 56 thereby preventing unwarranted trapping of such liquid within the cavity 55.

Figure 6:
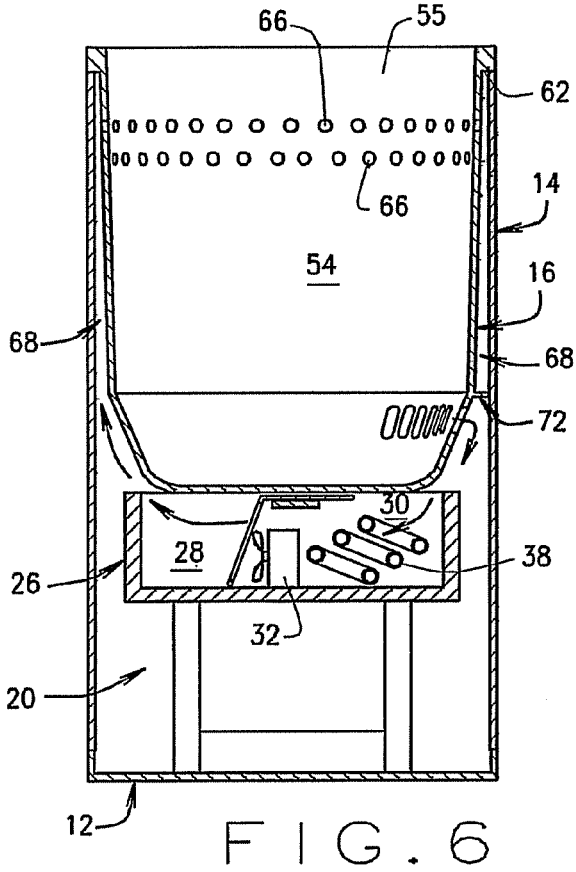
FIG. 6 is a partial side elevational cross-sectional view of the product merchandising unit of FIG. 1.

The upper end portion 52 of tub member 16 includes a top rim portion 58 and an annular downturned flange portion 60 extending therearound, the portions 58 and 60 forming an annular outer groove or space 62 adapted to receive the upper edge portion 44 of outer body member 14 when the tub member 16 is positioned within body member 14 as best shown in FIG. 6. The tub member or product holding container 16 is shaped and dimensioned so as to fit within the outer body member 14 and is suspended therein from the top edge 44 thereof by the rim portions 58 and 60. In this regard, it is important that the top peripheral edge of the body member 14 engage the annular slot or space 62 formed by the projecting downturned rim portions 58 and 60 so that the tub member 14 will be adequately supported when filled with product. In some embodiments, the tub member 16 may be sized such that the lower bottom wall portion 50 will rest upon plate member 64 or other structure associated with the upper housing member 26 of refrigeration unit 20 when tub member 14 is positioned within outer body member 14. This likewise provides added support to bottom wall portion 50 when the product holding cavity 55 is filled with product. In some embodiments, a gasket member (not shown) will be positioned between the upper surface portion of refrigeration unit 20 and the bottom wall portion 50 of tub member 14 to more effectively seal and segregate the supply air side portion 28 of refrigeration unit 20 from the return air side portion 30.

Importantly, the annular side wall 54 of tub member 16 includes a first plurality of openings 66 positioned and located substantially around the top portion thereof as best illustrated in FIG. 4 for allowing cold air delivered from refrigeration unit 20 to enter the product holding cavity 55 for circulation around product containers positioned therewithin. In this regard, the openings 66 may include any plurality of openings including any plurality of rows of openings 66 as illustrated in FIG. 4. The openings 66 may also take on any size and/or shape and may include elongated slots. In a preferred embodiment, the openings 66 extend completely around the periphery of annular side wall 54.

As best illustrated in FIG. 6, when tub member 16 is cooperatively engaged with the outer body member 14, a space, chamber or channel 68 is formed by and between such members and by and between the upper portion of refrigeration unit 20 so as to form a duct for efficiently channeling cold air delivered from the supply air side portion 28 of refrigeration unit 20 to the products positioned within the tub member 16 via openings 66. As cold air is delivered from supply side portion 28, it will circulate completely around annular side wall 54 of tub member 16 via space or duct 68 for ingress through openings 66 into the interior cavity portion 55 of tub member 16. The space formed by and between annular side wall 54, outer body member 14, and the upper portion of refrigeration unit 20 function as duct work for properly channeling cold air from refrigeration unit 20 to the interior cavity portion 55 of tub member 16.

Still further, the annular wall portion 54 of tub member 16 likewise includes a second set of openings or slots 70 located preferably along only a portion of the bottom portion of tub member 16 as best illustrated in FIGS. 4 and 5 for allowing the cold air which has circulated around the product containers positioned within the interior product cavity 55 to exit the product holding cavity 55 for recirculation through the refrigeration unit 20. In this regard, tub member 16 is positioned within outer body member 14 such that the openings or slots 70 are positioned and located adjacent to the return air side 30 of refrigeration unit 20. Still further, in order to segregate the return air exiting tub member 16 through the opening or slots 70 from the cold air which is being delivered from the supply air side portion 28 of refrigeration unit 20, a flange member 72 is associated with the lower portion of the annular wall portion 54 of tub member 16 as best illustrated in FIG. 4. Flange member 72 extends above the plurality of openings 70 as well as adjacent the respective opposite ends of such plurality of openings 70 as illustrated in FIG. 4 so as to completely segregate the space around such openings 70 and so as to prevent any return air exiting the openings 70 from being recycled back to the top portion of tub member 16 without first going through refrigeration unit 20. Flange member 72 can be appropriately shaped and dimensioned to accomplish this task and flange member 72 can be formed integral with side wall 54 or it can be attached thereto by any suitable means. When tub member 16 is positioned within outer body member 14, flange member 72 in conjunction with body member 14 forms a segregated compartment or space for allowing the return air to be funneled directly to the return air side portion 30 of refrigeration unit 20.

Depending upon the construction of the base unit 12, body member 14 and tub member 16 and/or depending upon the particular application involved, it is also recognized and anticipated that the plurality of openings 66 may be associated with the bottom portion of tub member 16 and that the plurality of openings 70 may be associated with the top portion of tub member 16. Still further, segregation means 72 can likewise be fashioned and constructed to segregate the cold supply air from the return air as previously explained such that air exiting the openings 70 will be directed to the return air side 30 of refrigeration unit 20 and will not be directed back to the openings 66 without first passing through refrigeration unit 20. Appropriate insulation means may also be utilized between certain portions of the space formed by and between the outer body member 14 and the tub member 16 so as to further insulate portions of the overall unit 10 to likewise help retain the cold temperature within the cooler cavity 55.

As best illustrated in FIG. 1, a lid member 18 may be hingedly or otherwise attached to the upper portion of the tub member 16 to provide easy access to the interior cavity 55. In the particular embodiment illustrated in FIGS. 4 and 5, the lid member 18 is hingedly attached to the top rim portion 58 of tub member 16 and includes a straight flat segment along a portion of the periphery thereof which facilitates attachment to a corresponding flat segment portion 74 associated with rim portion 58 by any suitable means. The lid member 18 is preferably made of a clear plastic material to enhance the visibility of the chilled products displayed and placed within the cooler cavity 55. The lid member 18 may likewise include a handle member 76 for grasping and lifting the lid member 18 to its open position, and the lid member 18 may be counterbalanced if necessary so as to maintain the lid member 18 in an erect position when moved to its open position. It is also recognized and anticipated that the lid member 18 may be non-pivotable and simply rest upon or otherwise engage positioning and locating means on the top rim portion 52 of tub member 16. Although any suitable lid member may be utilized to retain the cold temperature within the cooler cavity 55, the lid member 18 may also be eliminated in certain embodiments depending upon the cooling capacity of the refrigeration unit 20 to allow an even fuller viewing of the products positioned and stored within the product merchandising unit 10. It is also recognized and anticipated that the lid member 18 may be formed with a domed center, and the lid member 18 may take on any suitable size and shape depending upon the configuration of the outer body member 14 and corresponding tub member 16.

Still further, lid member 18 may also include means for holding and displaying visual information such as promotional advertisements and other advertising indicia for promoting the products displayed within the product holding cavity 55 such as the retaining projections and other means associated with the lid member disclosed in U.S. Pat. No. 6,637,233. Graphics and other advertising indicia may likewise be applied directly to the outer body member 14, or body member 14 may include spaced opposed channel members or other means positioned at predetermined locations on the outer surface of body member 14 so as to cooperatively engage and hold advertising information adjacent thereto such as the channel panel mounting means disclosed in U.S. Pat. No. 5,448,844. It is anticipated and recognized that other graphic arrangements and artistic designs may likewise be utilized and incorporated onto the exterior portion of the outer body member 14 to further enhance the beauty and appearance of the overall unit and/or to promote and advertise the sale of the particular chilled products stored and displayed therein.

It is also recognized and anticipated that tub member 16 may be positioned and supported within body member 14 via a wide variety of other suitable means such as through the use of a floor member positionable within the body member 14 or positionable over the top portion of the refrigeration unit 20. In this case, such floor member would include appropriate opening(s) or other means for allowing cold air delivered from the refrigeration unit 20 to pass therethrough to the tub member 16 and appropriate opening(s) or other means for allowing air exiting from tub member 16 to return to the refrigeration unit 20.

Figure 7:
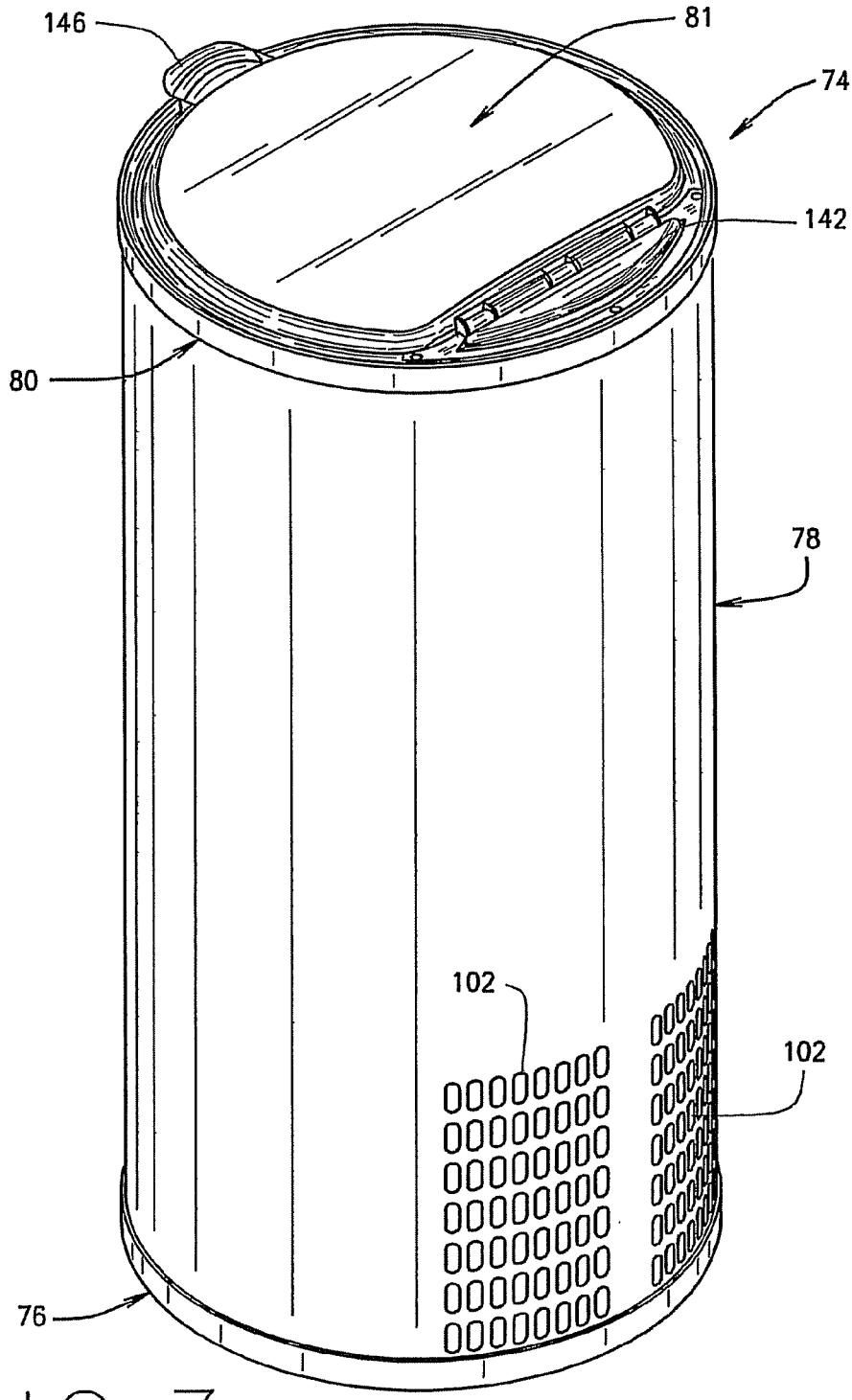
FIG. 7 is a perspective view of another embodiment of a product merchandising unit constructed according to the teachings of the present invention.
Figure 8:
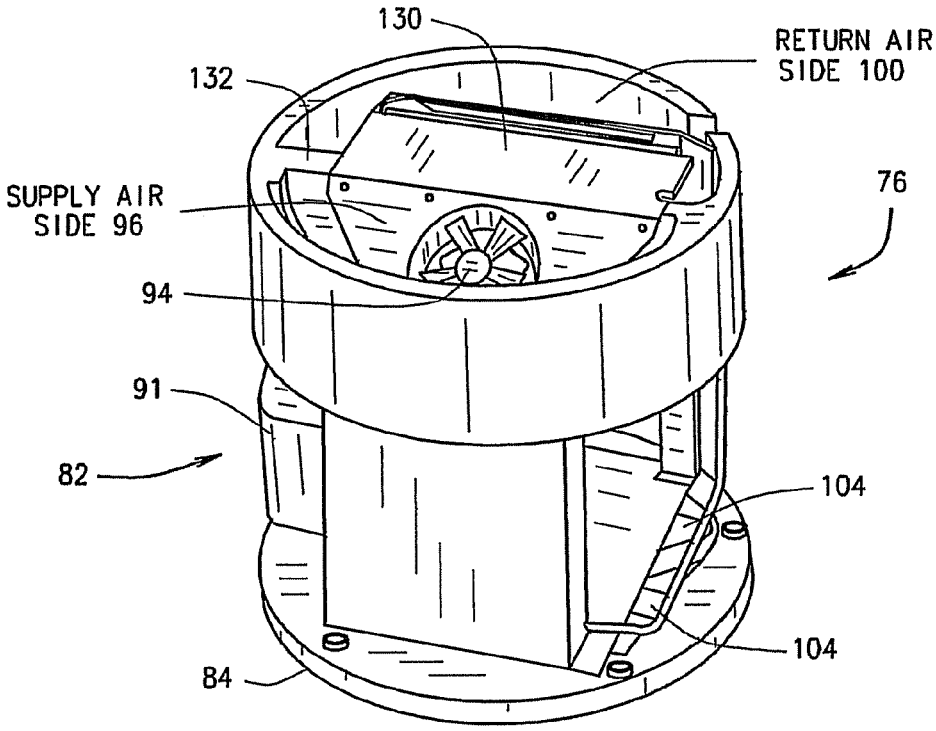
FIG. 8 is a perspective view of the base unit associated with the product merchandising unit of FIG. 7.
Figure 9:
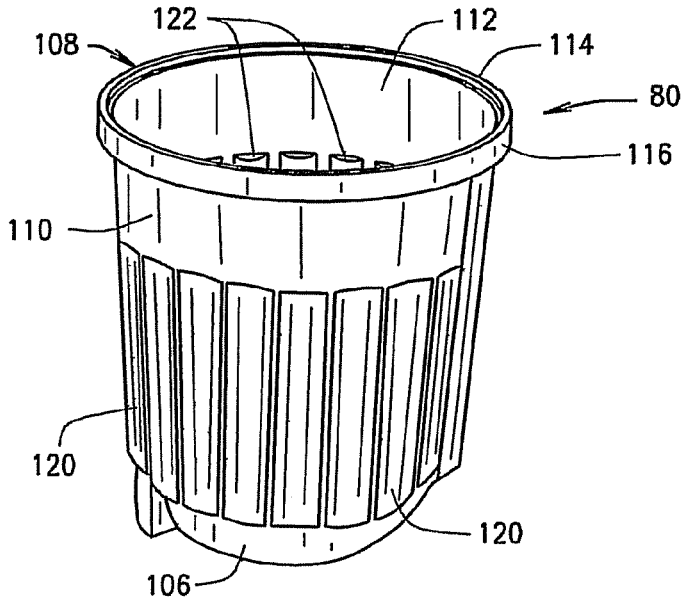
FIG. 9 is perspective view of the tub member or product holding container associated with the product merchandising unit of FIG. 7.
Figure 10:
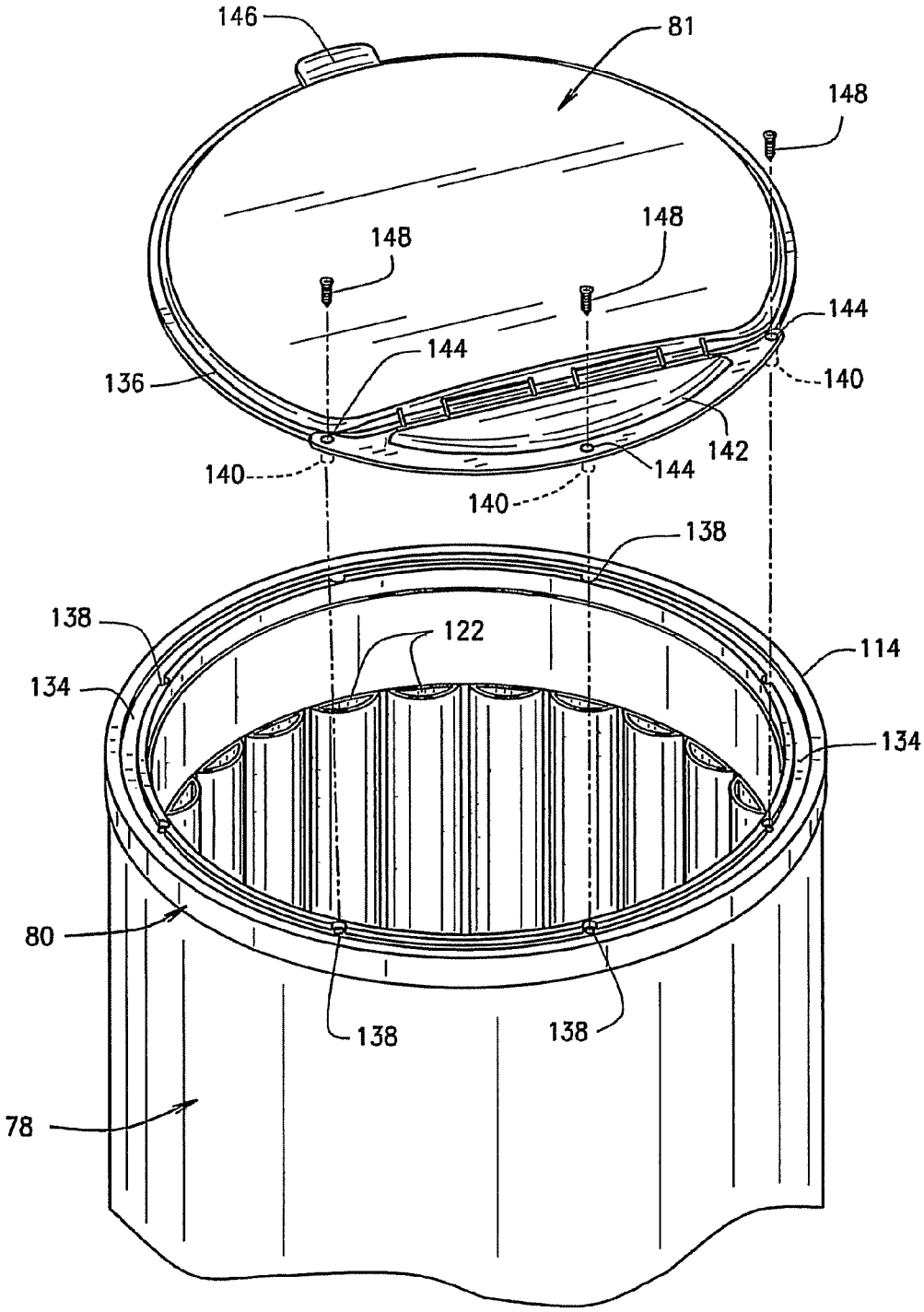
FIG. 10 is a partial perspective view of the top portion of the product merchandising unit of FIG. 7 showing the upper edge portion of the tub member and the inlet openings associated therewith when engaged with the body member.
Figure 11:
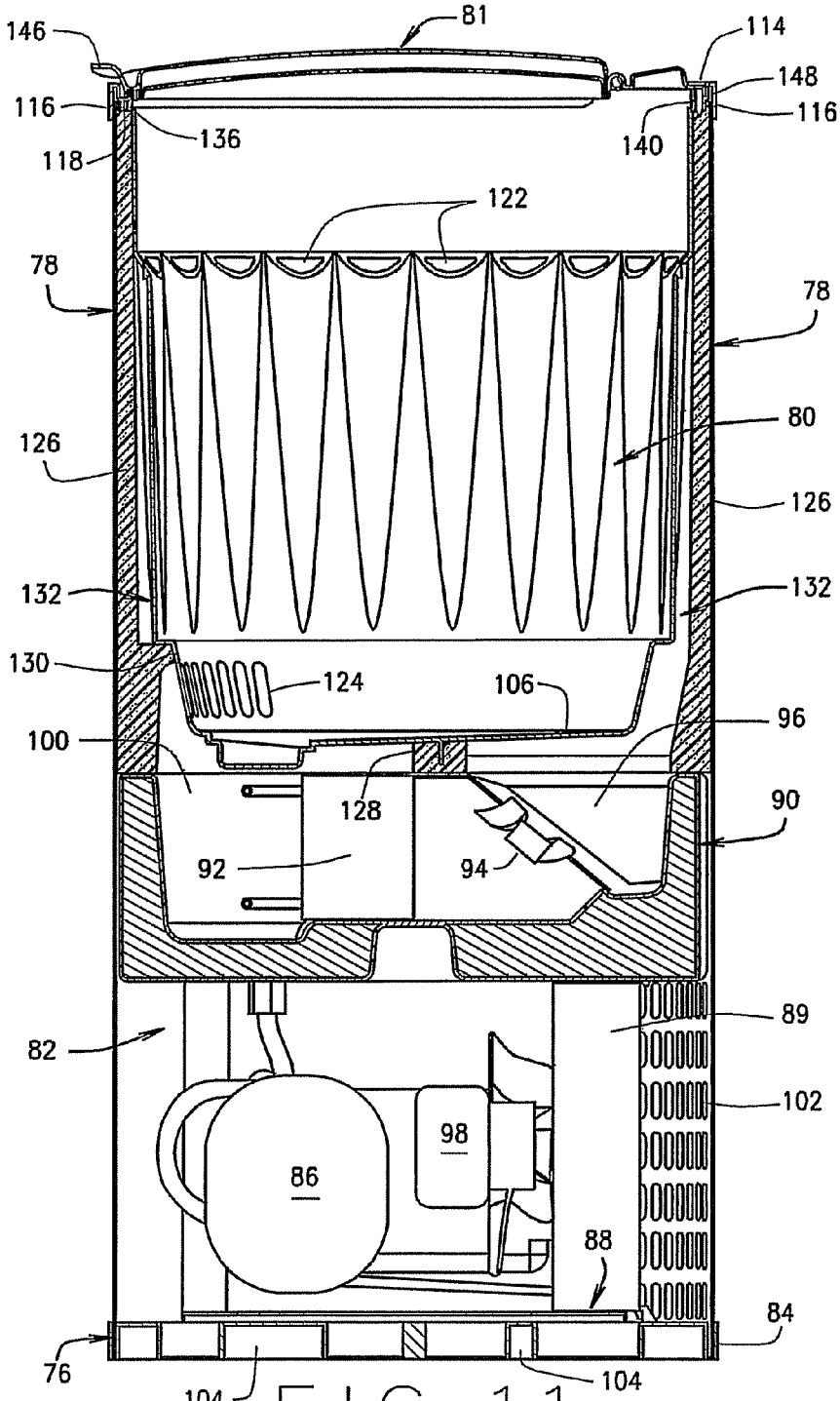
FIG. 11 is a partial side elevational cross-sectional view of the product merchandising unit of FIG. 7.

FIGS. 7-11 illustrate another embodiment 74 of a product merchandising unit constructed according to the teachings of the present invention. The product merchandising unit 74 likewise includes a base unit 76, a generally hollow outer body member 78, a correspondingly shaped tub member or product holding container 80, and a lid member 82. As best illustrated in FIGS. 8 and 11, the base unit 76 includes a refrigeration unit 82 fixedly mounted to a base assembly 84. Like the base assembly 22, base assembly 84 can likewise include a plurality of castors or other wheel rolling means (not shown) for facilitating movement of the overall unit 74 from one location to another.

Refrigeration unit 82 is likewise a totally integrated system for providing cold forced-air to the products positioned within the tub member 80. Like refrigeration system 20, refrigeration system 82 can be of any conventional construction and such refrigeration system is mounted to the base assembly 84 in a conventional manner as previously explained. Refrigeration unit 82 includes a compressor assembly 86, a compressor frame base 88, a condenser 89, an evaporator housing 90 which includes a supply air side portion 96 and a return air side portion 100, an evaporator core 92, a first fan means 94 for delivering cold air from the supply air side portion 96 to the tub member or product holding container 80, a second fan means 98 positioned adjacent to or in the vicinity of the condenser 89 for pulling air into the base unit 76 from the atmosphere and across the condenser 89 for cooling purposes, a condensation pan 91, appropriate tubing and valving, and other system components. Return air recycled from tub member 80 via the return air side 100 associated with the evaporator housing 90 is cycled through the refrigeration system 82 for recooling and is thereafter recirculated to the tub member 80 via the circulation fan 94 as previously explained. Refrigeration unit 82 will likewise include appropriate power means for providing electrical power to the compressor unit and other electrical components for cooling air in a conventional manner. As with refrigeration unit 20, it is anticipated and recognized that refrigeration unit 82 may likewise take on a wide variety of different configurations including different components or mechanisms for providing cold forced-air to be delivered from the supply air side portion 96 to tub member 80.

The outer body member or shell member 78 is substantially similar in construction as body member 14 and can be fabricated as a single unitary unit, or such member can be formed from a plurality of cooperatively engageable panels, or from a single flat sheet of flexible or resilient material which includes complimentary interlocking edge portions for cooperatively attaching opposed end portions of the sheet member to form the body member 78. Like body member 12, body member 78 can likewise take on a wide variety of different shapes and configurations. In addition, like body member 14, the lower end portion of body member 78 is likewise shaped and configured so as to cooperatively receive refrigeration unit 82 as best illustrated in FIG. 11 and the lower end portion of body member 78 is likewise removably attachable to the base unit 76 via any suitable conventional means as previously explained with respect to body member 14. Other means for attaching body member 78 to base unit 76 are likewise envisioned and may be utilized without departing from the spirit and scope of the present invention.

Body member 78 likewise includes a plurality of openings 102 which allow ambient air to enter the lower portion of the overall unit 74 for cooling the various components of refrigeration unit 82 such as condenser 89. The openings 102 differ from the openings 46 and 48 in that they are formed in the shape of elongated openings or slots as compared to the shape of openings 46 and 48 illustrated in FIGS. 1 and 2. Ambient air is drawn into the refrigeration unit 82 via fan means 98 for cooling the various components associated with the refrigeration unit 82 such as condenser 89 and such air is allowed to exit base unit 76 via openings 104 associated with the bottom portion of base unit 76 as best illustrated in FIG. 8. Other arrangements and means for cooling refrigeration unit 82 are likewise anticipated and recognized. Once positioned over refrigeration unit 82 and base unit 76, the outer body member 78 substantially encloses refrigeration unit 82 as best illustrated in FIG. 11.

Referring to FIGS. 9-11, the tub member or product holding container 80 is likewise preferably a one-piece member and includes a lower bottom wall portion 106, an opposite open upper end portion 108 and a continuous side wall portion 110 extending therebetween defining an internal cavity 112 for holding products therewithin. The lower bottom wall portion 106 may include a drain opening with appropriate tubing for removing any condensation which may accumulate within the product holding cavity 112. Like tub member 16, and as best illustrated in FIG. 11, the upper end portion 108 of tub member 80 likewise includes a top rim portion 114 and an annular downturned flange portion 116 extending therearound, the portions 114 and 116 forming an annular outer groove or space 118 adapted to receive the upper edge portion of the outer body member 78 when the tub member 80 is positioned therewithin as best shown in FIG. 11. Like tub member 16, tub member 80 is shaped and dimensioned so as to fit within the outer body member 78 and is suspended therein from the top edge thereof by rim portions 114 and 116.

The annular side wall 110 of tub member 80 includes a plurality of fluted areas 120 as best illustrated in FIGS. 9-11, each fluted area 120 terminating at its upper end portion with an opening 122. The openings 122 are positioned and located so as to open into the interior cavity 112 associated with tub member 80 for allowing cold air delivered from the refrigeration unit 82 to enter the product holding cavity 112 for circulation around product containers positioned therewithin. The plurality of fluted areas 120 and their corresponding openings 122 being preferably positioned and located substantially around the annular side wall 110 as best illustrated in FIGS. 9 and 11. Each fluted area 120 is designed to allow the cold forced-air being delivered from the supply air side portion 96 of the refrigeration unit 82 to flow and enter the fluted area and thereafter funnel such cold air upwardly into and through the openings 122 for circulation within the internal cavity 112. The fluted areas 120 help to trap and guide the cold air into the tub member 80. The openings 122 may also take on any size and/or shape depending upon the size and shape of the fluted areas 120.

As best illustrated in FIG. 11, the lower portion of tub member 80 likewise includes a second set of openings or slots 124 (FIG. 11) preferably located along only a portion of the bottom portion of tub member 80 for allowing the cold air which has circulated around the product containers positioned within the interior product cavity 112 to exit the product holding cavity 112 for recirculation through the refrigeration unit 82. In this regard, like tub member 16, tub member 80 is positioned within outer body member 78 such that the openings or slots 124 are positioned and located adjacent to the return air side 100 of refrigeration unit 82.

In order to segregate the return air exiting tub member 80 through the openings or slots 124 from the cold air which is being delivered from the supply air side portion 96 of refrigeration unit 82, an insulation foam member such as an expanded polystyrene foam member 126 is positioned as best illustrated in FIG. 11 by and between tub member 80, body member 78, and the top portion of the evaporator housing 90. The insulation member 126 is preferably of a one-piece construction and is annularly shaped as indicated in FIG. 11 so as to fit into the space formed by and between the members 78 and 80 and so as to extend around the upper periphery of evaporator housing member 90. In addition, insulation member 128 likewise extends completely across the plate member 130 (FIG. 8) associated with refrigeration unit 82 as well as completely across the supporting rib or support member 132 (FIG. 8) associated with the evaporator housing member 90 so as to completely seal and segregate the supply air side portion 96 from the return air side portion 100. Although it is preferred that the insulation member 128 be integrally formed with insulation member 126, it is recognized and anticipated that members 128 and 126 may be separate members suitably attached or engaged to accomplish segregation and it is recognized and anticipated that insulation member 126 may likewise be comprised of multiple parts which are appropriately attached or otherwise engaged, mated or abutted with each other to form the completed insulation member. Still further, as best shown in FIG. 11, insulation member 126 likewise includes a flange portion 130 which extends above the plurality of openings or slots 124 and acts in conjunction with insulation members 126 and 128 to completely segregate the space around the openings 124 so as to prevent any return air exiting the openings 124 from being recycled back to the top portion of tub member 80 without first going through refrigeration unit 82. When the tub member 80 is positioned within the outer body member 78, insulation member 126 including flange portion 130 and insulation member 128 in conjunction with the lower portion of tub member 80 and the upper portion of evaporator housing 90 form a segregated compartment or space for allowing the return air to be funneled directly to the return air side portion 100 of refrigeration unit 82.

As best illustrated in FIG. 11, when the tub member 80 is cooperatively engaged with the outer body member 78 and insulation members 126 and 128 are properly positioned therebetween and on top of evaporator housing 90, a space, chamber or channel 132 is formed by and between such members and by and between the upper portion of refrigeration unit 82 so as to form a duct for efficiently channeling cold air delivered from the supply air side portion 96 of refrigeration unit 82 to products positioned within the tub member 80 via the fluted areas 120 and openings 122. As cold air is delivered from the supply air side portion 96, it will circulate completely around annular side wall 110 of tub member 80 via space or duct 132 for ingress along the fluted areas 120 and through openings 122 into the interior cavity portion 112 of tub member 80. As with tub member 16, the space formed by and between insulation members 126 and 128, the tub member 80, and the upper portion of refrigeration unit 82 function as duct work for properly channeling cold air from refrigeration unit 82 to the interior cavity 112 of tub member 80.

Still further, in the embodiment 74 illustrated in FIG. 11, the lower bottom wall portion 106 of tub member 80 will rest upon the upper portion of the evaporator housing 90 and insulation member 128, or other structure associated therewith, thereby providing added support to the bottom wall portion of tub member 80 when the product holding cavity 112 is filled with product.

If the temperature of the air exiting the openings 124 at the bottom of tub member 80 is not properly maintained, freezing of the evaporator core 92 can occur. In order to prevent freezing of the evaporator core 92, the area of the openings 122 associated with the fluted areas 120 must be balanced with respect to the area of the openings 124 so that sufficient air flow is allowed to pass over the evaporator core 92. It has been found that if the total area of the openings or slots 124 associated with the bottom portion of tub member 80 is equal to or greater than the total area of the openings 122 associated with the fluted areas 120 at the top portion of the tub member 80, then evaporator core freezing will be avoided. This is because this specific relationship between the areas of the inlet and outlet openings associated with tub member 80 allows air to be pulled through the interior cavity portion 112 faster than cold air is being delivered from the supply air side portion 96 of the refrigeration unit 82 thereby preventing evaporator core freezing. This hole or opening area relationship also allows the product to cool down faster.

As best illustrated in FIGS. 7 and 11, a lid member 81 may be engaged or otherwise attached to the upper portion of the tub member 80 to provide easy access to the interior cavity 112. In the particular embodiment illustrated in FIGS. 7-11, rim portion 114 includes a groove or channel 134 as best illustrated in FIG. 10 adaptable for receiving a corresponding rib, ridge or projection 136 associated with the peripheral edge portion of lid member 81. The cooperatively engageable portions 136 and 138 preferably form a sufficiently tight friction fit when lid member 81 is engaged with rim portion 114. In addition, as best illustrated in FIG. 10, channel portion 134 includes a plurality of spaced indentations 138 which are positioned and located around rim portion 114 so as to cooperatively mate with corresponding projections 140 associated with the rear portion 142 of lid member 81. Because the indentations 138 and the corresponding projections 140 for mating therewith are respectively equally spaced around the periphery of rim portion 114 and the rear portion 142 of lid member 81, the lid member 81 can be rotated at predetermined increments based upon the spacing between the respective indentations 138 so as to position the front portion of the lid member 81 at various locations around the periphery of the body member 78 thereby selectively determining where the lid member will open relative to the overall unit. In other words, in the embodiment illustrated in FIG. 10, the rear portion 142 of lid member 81 includes three (3) projections 140 spaced identical to the spacing between the indentations 138 associated with rim portion 114. The rear lid portion 142 can be maneuvered and rotated so as to align the three (3) projections 140 associated therewith with any three (3) consecutively spaced indentations 138 associated with tub member 80. This enables a user to selectively determine which portion of the overall unit 74 will be the front of the unit by selectively positioning the lid member 81 relative thereto. The projections 140 which mate with and seat within the indentations 138 hold the lid member 81 in its selective position relative to rim portion 114 and prevent the lid member from being further rotated or otherwise moved during use. The projections 140 may likewise include an opening 144 extending partially or totally therethrough for receiving a screw or other fastening means 148 for further attaching the rear portion 142 of lid member 81 to rim portion 114 of tub member 80. It is recognized and anticipated that cooperatively interengaging elements other than the elements 134 and 136 and the elements 138 and 140 can be utilized to accomplish the interengagement therebetween without departing from the spirit and scope of the present invention.

Lid member 81 is preferably made of a clear plastic material to enhance the visibility of the chilled products displayed and positioned within the cooler cavity 112. Lid member 81 includes a handle member 146 for grasping and lifting the lid member to its open position, and lid member 81 may be counter-balanced if necessary so as to maintain the lid member 81 in an erect position when moved to its open position.

As previously mentioned, it is recognized and anticipated that the present product merchandising units 10 and 74 and all of their respective internal components may be conveniently fashioned into a wide variety of different sizes and configurations other than circular or cylindrical without impairing the teachings and practice of the present invention. In this regard, the size and shape of the base units 12 and 76, the body members 14 and 78, the tub members 16 and 80, and the lid members 18 and 81 will be made compatible with each other so as to be assembled in a manner substantially similar to that disclosed above.

The simplicity, durability, flexibility and versatility of the present product merchandising units 10 and 74 greatly increase their usefulness and effectiveness for encouraging and promoting point-of-purchase-sales. In this regard, if access to refrigeration unit 20 or 82 is needed for any purpose such as servicing the system, the outer body member 14 or 78 with the respective tub member 16 or 80 attached thereto can be easily and quickly removed from the base unit 12 or 76 by simply removing a plurality of screws or other fastening means which removably attach the lower body portion to the base unit. Once the fastening means are removed, the body member can be lifted off of the base unit thereby exposing the refrigeration unit to inspection, service and/or repair. In the event that the refrigeration unit must be serviced or otherwise fails, the entire base assembly 12 or 76 including the refrigeration unit mounted thereon can be packaged and shipped for appropriate maintenance. If this occurs, a new base unit housing a new refrigeration system can be easily substituted for the serviced base unit and this replacement can be easily handled by unskilled personnel while the unit is still in the store environment. Replacement of the refrigeration unit can be made with a simple screwdriver or other appropriate tools for removing the fastening means coupling the body member to the base member. This substantially reduces downtime.

Still further, it is also recognized that the body members 14 and 78 and their corresponding tub members 16 and 80 can be integrally formed as a one-piece unit and that the associated refrigeration unit can be structured and configured differently and may include different components than those described above. Also, other methods of applying refrigeration means to the product containers positioned and located within product cavities 55 and/or 112 are likewise recognized and anticipated.

Thus there has been shown and described several embodiments of a novel refrigerated product merchandising unit for use in displaying and merchandising chilled articles, which product merchandising units fulfill all of the objects and advantages sought therefore. Many changes, modifications, variations and other uses and applications of the present product merchandising units will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. A product merchandising unit for holding and displaying chilled products comprising:

a body member having opposed top and bottom end portions and wall means extending therebetween;

a tub member including top and bottom portions and adapted to hold products positioned therein, said tub member being positionable within said body member and including means for supporting said tub member adjacent the top end portion of said body member; and a base member having a refrigeration unit associated therewith, said refrigeration unit being positionable within said body member and being adapted for providing cold air to said tub member;

said body member, tub member, and refrigeration unit forming space therebetween for channeling cold air to and from said refrigeration unit and to and from the interior portion of said tub member;

said tub member including a plurality of fluted areas for allowing air from said refrigeration unit to enter the interior portion of said tub member, said plurality of fluted areas including a first plurality of openings, each of said first plurality of openings being associated with one of said fluted areas, said first plurality of openings being positioned and located adjacent to and substantially around the top end portion of said tub member, and a second plurality of openings for allowing air from within the interior portion of said tub member to exit said tub member for return to said refrigeration unit, the air exiting said second plurality of openings being channeled to said refrigeration unit for recirculation therethrough and back to said first plurality of openings associated with said tub member.

2. The product merchandising unit defined in claim 1 wherein said base member includes wheel means.

3. The product merchandising unit defined in claim 1 wherein said tub member includes a drain opening.

4. The product merchandising unit defined in claim 1 wherein said body member is cylindrical in shape.

5. The product merchandising unit defined in claim 1 wherein each of said fluted areas allows air from said refrigeration unit to flow therethrough for passage through said first plurality of openings.

6. The product merchandising unit defined in claim 1 wherein said means for supporting said tub member adjacent the top end portion of said body member includes a rim portion cooperatively engageable with the top end portion of said body member.

7. The product merchandising unit defined in claim 1 wherein said second plurality of openings being positioned and located adjacent the bottom end portion of said tub member.

8. The product merchandising unit defined in claim 7 wherein said second plurality of openings are positioned and located along only a portion of the bottom end portion of said tub member.

9. The product merchandising unit defined in claim 1 wherein said body member includes a wheel base assembly, said refrigeration unit being mounted to said wheel base assembly.

10. The product merchandising unit defined in claim 1 including a lid member associated with said tub member.

11. The product merchandising unit defined in claim 1 including means for segregating the air exiting said second plurality of openings and returning to said refrigeration unit from the air being supplied by said refrigeration unit to said first plurality of openings.

12. The product merchandising unit defined in claim 11 wherein said means for segregating includes a flange member positioned adjacent to said second plurality of openings.

13. The product merchandising unit defined in claim 1 wherein said refrigeration unit includes a supply air side and a return air side, said refrigeration unit supplying cold air from said supply air side to the space formed by and between said body member, said tub member and said refrigeration unit for delivery to said first plurality of openings, said refrigeration unit receiving air from the interior portion of said tub member via said second plurality of openings for passage to the return air side of said refrigeration unit for recirculation therethrough and back out through said supply air side.

14. The product merchandising unit defined in claim 1 wherein the area of the openings associated with said second plurality of openings is equal to or greater than the area of the openings associated with said first plurality of openings.

15. The product merchandising unit defined in claim 11 wherein said means for segregation includes at least one insulation member positioned by and between said body member, said tub member, and the top portion of said base member.

16. The product merchandising unit defined in claim 1 including an insulation member positioned by and between said body member, said tub member, and said refrigeration unit.

17. The product merchandising unit defined in claim 16 wherein said insulation member includes a flange portion which extends above said second plurality of openings for segregating the air exiting said second plurality of openings for return to said refrigeration unit from the air being delivered by said refrigeration unit to said first plurality of openings.

18. A refrigerated product merchandising unit for storing and displaying chilled products comprising:

a substantially hollow body member having opposed top and bottom end portions and wall means extending therebetween;

a product holding container adapted for holding products positioned therein, said product holding container being positionable within said body member and including means for supporting said product holding container adjacent the top end portion of said body member; and a base member having a refrigeration unit associated therewith, said refrigeration unit being sized and shaped so as to be insertably receivable within said body member, said refrigeration unit including a supply air side and a return air side, said refrigeration unit delivering cold air from said supply air side to said product holding container and receiving air from said product holding container for passage to the return air side;

said product holding container including a side wall portion and having a first plurality of openings extending through said side wall portion, said first plurality of openings being positioned and located adjacent the top end portion of said product holding container for allowing air from the supply air side of said refrigeration unit to enter the interior portion of said product holding container, said product holding container further including a second plurality of openings extending through said side wall portion for allowing air from the interior portion of said product holding container to exit said product holding container for passage to the return air side of said refrigeration unit, said second plurality of openings being located adjacent the bottom end portion of said product holding container; and means for segregating the air exiting said product holding container from said second plurality of openings for return to the return air side of said refrigeration unit from the air being delivered from the supply air side of said refrigeration unit to said first plurality of openings, said means for segregating the air including at least one insulation member positioned by and between said body member, said product holding container, and the top portion of said base member so as to segregate the space around said second plurality of openings such that air exiting said second plurality of openings cannot be channeled back to said first plurality of openings without first passing through the return air side of said refrigeration unit.

19. The refrigerated product merchandising unit defined in claim 18 wherein said first plurality of openings extend substantially completely around said side wall portion adjacent the top end portion of said product holding container.

20. The refrigerated product merchandising unit defined in claim 18 wherein said second plurality of openings extend around only a portion of said side wall portion adjacent the bottom end portion of said product holding container.

21. The refrigerated product merchandising unit defined in claim 18 including a lid member for positioning adjacent the top end portion of said product holding container.

22. The refrigerated product merchandising unit defined in claim 18 including a plurality of openings associated with the bottom end portion of said body member for cooling said refrigeration unit.

23. The product merchandising unit defined in claim 18 wherein said product holding container includes a plurality of fluted areas, each of said fluted areas being associated with one of said first plurality of openings.

24. A refrigerated product merchandising unit for storing and displaying chilled products comprising:

a substantially hollow body member having opposed top and bottom end portions and wall means extending therebetween;

a product holding container having a bottom wall portion, an opposite open upper end portion, and a continuous side wall portion extending therebetween defining an internal cavity for holding products therewithin, said product holding container being positionable within said body member and including a first plurality of openings extending through said side wall portion adjacent the top end portion thereof, said first plurality of openings extending substantially completely around the periphery of said product holding container, said product holding container further including a second plurality of openings extending through said side wall portion adjacent the bottom end portion thereof, said second plurality of openings extending only along a portion of the periphery of said product holding container;

a base member having a refrigeration system associated therewith, said refrigeration system being sized and shaped so as to be insertably receivable within said body member, said refrigeration system including a supply air side and a return air side for delivering and receiving air to and from said product holding container;

said body member, said product holding container, and said refrigeration system defining space therebetween for allowing cold air to be delivered from the supply air side of said refrigeration system to said first plurality of openings for circulation within the internal cavity of said product holding container and for allowing air exiting the internal cavity of said product holding container from said second plurality of openings to be delivered to the return air side of said refrigeration system for recirculation therethrough; and flange means extending around said second plurality of openings for segregating the air exiting said second plurality of openings from within the interior cavity of said product holding container for passage to the return air side of said refrigeration unit from the cold air being delivered from the supply air side of said refrigeration system to said first plurality of openings associated with said product holding container such that air exiting said second plurality of openings must pass through said refrigeration system before being recirculated to said first plurality of openings.

25. The refrigerated product merchandising unit defined in claim 24 wherein said second plurality of openings are positioned and located in the vicinity of the return air side of said refrigeration unit.

26. The refrigerated product merchandising unit defined in claim 24 wherein said product holding container includes means for supporting said product holding container adjacent the top end portion of said body member.

27. The refrigerated product merchandising unit defined in claim 26 wherein said means for supporting said product holding container adjacent the top end portion of said body member includes a rim portion and an annular downturned flange portion extending around the top end portion of said product holding container, said rim portion and said downturned flange portion forming a space therebetween adapted to receive the top end portion of said body member.

28. The refrigerated product merchandising unit defined in claim 24 including a lid member positionable on the top end portion of said product holding container.

29. The refrigerated product merchandising unit defined in claim 24 wherein said body member includes a plurality of openings positioned and located adjacent the bottom end portion thereof for cooling said refrigeration system.

30. The refrigerated product merchandising unit defined in claim 29 wherein said plurality of openings associated with said body member includes a first plurality of openings for allowing ambient air to enter said body member and a second plurality of openings for allowing air to exit said body member.

31. The refrigerated product merchandising unit defined in claim 24 wherein said body member is substantially cylindrical in shape.

32. The refrigerated product merchandising unit defined in claim 31 wherein said product holding container and said base member are shaped and dimensioned so as to be compatible for being positioned within said body member.

33. The refrigerated product merchandising unit defined in claim 24 wherein the bottom end portion of said body member is removably attachable to said base member.

34. A refrigerated product merchandising unit for storing and displaying chilled products comprising:

a substantially hollow body member having opposed top and bottom end portions and wall means extending therebetween;

a product holding container adapted for holding products positioned therein, said product holding container being positionable within said body member and including means for supporting said product holding container adjacent the top end portion of said body member; and a base member having a refrigeration unit associated therewith, said refrigeration unit being sized and shaped so as to be insertably receivable within said body member, said refrigeration unit including a supply air side and a return air side, said refrigeration unit delivering cold air from said supply air side to said product holding container and receiving air from said product holding container for passage to the return air side;

said product holding container including a plurality of fluted areas, each fluted area terminating adjacent the top end portion of said product holding container with an opening for allowing air from the supply air side of said refrigeration unit to enter the interior portion of said product holding container, the openings associated with said plurality of fluted areas constituting a first plurality of openings associated with said product holding container;

said product holding container further including a second plurality of openings extending therethrough for allowing air from the interior portion of said product holding container to exit said product holding container for passage to the return air side of said refrigeration unit, said second plurality of openings being located adjacent the bottom end portion of said product holding container; and insulation means for segregating the air exiting said product holding container from said second plurality of openings for return to the return air side of said refrigeration unit from the air being delivered from the supply air side of said refrigeration unit to said first plurality of openings.

35. The refrigerated product merchandising unit defined in claim 34 wherein said insulation means includes a flange portion extending above said second plurality of openings.

36. The refrigerated product merchandising unit defined in claim 34 wherein the area of the openings associated with said second plurality of openings is equal to or greater than the area of the openings associated with said first plurality of openings.

37. The refrigerated product merchandising unit defined in claim 34 wherein said fluted areas allow the air being delivered from the supply air side of said refrigeration unit to be guided towards said first plurality of openings.

38. The refrigerated product merchandising unit defined in claim 34 wherein said product holding container includes an upper peripheral rim portion, said product merchandising unit further including a lid member positionable adjacent the peripheral rim portion of said product holding container.

39. The refrigerated product merchandising unit defined in claim 38 wherein the upper peripheral rim portion of said product holding container includes a channel, and wherein said lid member includes a rib portion, the rib portion of said lid member being cooperatively engageable with the corresponding channel associated with the rim portion of said product holding container.

40. The refrigerated product merchandising unit defined in claim 38 wherein the upper peripheral rim portion of said product holding container includes a plurality of spaced indentations, and wherein at least a portion of said lid member includes a plurality of spaced projections, the plurality of spaced projections associated with said lid member being cooperatively engageable with at least some of said plurality of indentations associated with the upper peripheral rim portion of said product holding container.

41. The refrigerated product merchandising unit defined in claim 40 wherein the number of projections associated with said lid member are less than the number of indentations associated with said product holding container, said lid member being selectively positionable relative to the upper peripheral rim portion of said product holding container.

42. The refrigerated product merchandising unit defined in claim 34 including a plurality of openings associated with said body member for cooling said refrigeration unit.

43. The refrigerated product merchandising unit defined in claim 34 wherein said base member includes wheel means.

44. A product merchandising unit for holding and displaying chilled products comprising:

a body member having opposed top and bottom end portions and wall means extending therebetween;

a tub member adapted to hold products positioned therein, said tub member being positionable within said body member and including means for supporting said tub member adjacent the top end portion of said body member; and a base member having a refrigeration unit associated therewith, said refrigeration unit being positionable within said body member and being adapted for providing cold air to said tub member;

said body member, tub member, and refrigeration unit forming space therebetween for channeling cold air to and from said refrigeration unit and to and from the interior portion of said tub member;

said tub member including a first plurality of openings for allowing air from said refrigeration unit to enter the interior portion of said tub member, and a second plurality of openings for allowing air from within the interior portion of said tub member to exit said tub member for return to said refrigeration unit, the air exiting said second plurality of openings being channeled to said refrigeration unit for recirculation therethrough and back to said first plurality of openings associated with said tub member, and an insulation member positioned by and between said body member, said tub member, and said refrigeration unit, said insulation member including a flange portion which extends above said second plurality of openings for segregating the air exiting said second plurality of openings for return to said refrigeration unit from the air being delivered by said refrigeration unit to said first plurality of openings.

45. A refrigerated product merchandising unit for storing and displaying chilled products comprising:

a substantially hollow body member having opposed top and bottom end portions and wall means extending therebetween;

a product holding container adapted for holding products positioned therein, said product holding container being positionable within said body member and including means for supporting said product holding container adjacent the top end portion of said body member; and a base member having a refrigeration unit associated therewith, said refrigeration unit being sized and shaped so as to be insertably receivable within said body member, said refrigeration unit including a supply air side and a return air side, said refrigeration unit delivering cold air from said supply air side to said product holding container and receiving air from said product holding container for passage to the return air side;

said product holding container including a plurality of fluted areas, each fluted area terminating at one end portion thereof with an opening for allowing air from the supply air side of said refrigeration unit to enter the interior portion of said product holding container, the openings associated with said plurality of fluted areas constituting a first plurality of openings associated with said product holding container;

said product holding container further including a second plurality of openings extending therethrough for allowing air from the interior portion of said product holding container to exit said product holding container for passage to the return air side of said refrigeration unit, said second plurality of openings being located adjacent the bottom end portion of said product holding container;

insulation means for segregating the air exiting said product holding container from said second plurality of openings for return to the return air side of said refrigeration unit from the air being delivered from the supply air side of said refrigeration unit to said first plurality of openings;

said product holding container including an upper peripheral rim portion, said product merchandising unit further including a lid member positionable adjacent the peripheral rim portion of said product holding container, the upper peripheral rim portion of said product holding container including a channel and said lid member including a rib portion, the rib portion of said lid member being cooperatively engageable with the corresponding channel associated with the rim portion of said product holding container.

46. A refrigerated product merchandising unit for storing and displaying chilled products comprising:

a substantially hollow body member having opposed top and bottom end portions and wall means extending therebetween;

a product holding container adapted for holding products positioned therein, said product holding container being positionable within said body member and including means for supporting said product holding container adjacent the top end portion of said body member; and a base member having a refrigeration unit associated therewith, said refrigeration unit being sized and shaped so as to be insertably receivable within said body member, said refrigeration unit including a supply air side and a return air side, said refrigeration unit delivering cold air from said supply air side to said product holding container and receiving air from said product holding container for passage to the return air side;

said product holding container including a side wall portion and having a plurality of fluted areas associated therewith, said plurality of fluted areas including a first plurality of openings, each of said first plurality of openings being associated with one of said fluted areas, said first plurality of openings being positioned and located adjacent the top end portion of said product holding container for allowing air from the supply air side of said refrigeration unit to enter the interior portion of said product holding container, said product holding container further including a second plurality of openings extending through said side wall portion for allowing air from the interior portion of said product holding container to exit said product holding container for passage to the return air side of said refrigeration unit, said second plurality of openings being located adjacent the bottom end portion of said product holding container; and means for segregating the air exiting said product holding container from said second plurality of openings for return to the return air side of said refrigeration unit from the air being delivered from the supply air side of said refrigeration unit to said first plurality of openings.

47. The refrigerated product merchandising unit defined in claim 46 wherein said means for segregating air includes a flange member extending around said second plurality of openings so as to segregate the space around said openings such that air exiting said second plurality of openings cannot be channeled back to said first plurality of openings without first passing through the return air side of said refrigeration unit.

48. The refrigerated product merchandising unit defined in claim 46 wherein said means for segregating air includes at least one insulation member positioned by and between said body member, said product holding container, and the top portion of said base member so as to segregate the space around said second plurality of openings such that air exiting said second plurality of openings cannot be channeled back to said first plurality of openings without first passing through the return air side of said refrigeration unit.

* * * * *